United States Patent [19]

Pirota

[11] Patent Number: 4,536,677

[45] Date of Patent: Aug. 20, 1985

[54] GETTER ASSEMBLY WITH AN IMPROVED MEANS OF CONNECTING THE ANTENNA MOUNT TO THE GETTER MATERIAL CONTAINER

[75] Inventor: Franco Pirota, Milan, Italy

[73] Assignee: Saes Getters S.p.A., Milan, Italy

[21] Appl. No.: 549,407

[22] Filed: Nov. 7, 1983

[30] Foreign Application Priority Data

Nov. 11, 1982 [IT] Italy ..... 24194 A/82

[51] Int. Cl.[3] ..... H01J 29/94

[52] U.S. Cl. ..... 313/481; 313/558; 313/559; 313/561; 417/48; 445/55

[58] Field of Search ..... 313/481, 553, 558, 561, 313/559; 445/55; 417/48

[56] References Cited

U.S. PATENT DOCUMENTS 3,508,105 4/1970 Pappadis ..... 313/481
4,101,247 7/1978 Pirota et al. ..... 417/48
4,225,805 7/1980 Smithgall et al. ..... 313/481
4,323,818 4/1982 Madden et al. ..... 313/481

*Primary Examiner*—Arthur Kellogg
*Attorney, Agent, or Firm*—Quaintance & Murphy

[57] ABSTRACT

A getter assembly is described which has an antenna mount in the form of a small bar placed along the diameter of an annular container. The antenna mount is formed in such a way as to touch the container only in areas near to the inner wall. In order to reduce to a minimum the points and the areas of contact between the antenna mount and the getter material container, the connection of these two elements is made by means of two diametrically opposite spot welds near to the internal wall of the annular container and longitudinally disposed along the mount.

The mounting bar is preferably furnished with a downwardly dependent support member for maintaining the getter assembly away from the wall of the cathode ray tube in which it will be located.

5 Claims, 3 Drawing Figures

GETTER ASSEMBLY WITH AN IMPROVED MEANS OF CONNECTING THE ANTENNA MOUNT TO THE GETTER MATERIAL CONTAINER

BACKGROUND OF THE INVENTION

The present invention relates to an improved getter assembly which is able to avoid deformations due to unequal thermal expansion with consequent internal strains.

It is known that the getter assemblies are widely used in tubes for the representation of visual images, such as cathode ray tubes and kinescopes. In practical use the getter assembly is heated to a high temperature, usually by means of induction at high frequency, such as to cause evaporation of the gettering material contained within the getter assembly. This latter can be located within the cathode ray tube in the so called "antenna" position or attached to the anode bottom, but, whatever its position it is usually held by means of an integral support of a support in closed contact with it such as to maintain the getter holder as far as possible from the glass wall of the cathode ray tube in order to avoid that the high temperatures reached during heating of the getter asssembly can damage or even provoke rupture of the glass.

One of the disadvantages that may occur during heating of the getter is that the getter material container, usually of an annular or circular form, can become deformed as a consequence of the unequal thermal stresses due to the close relationship between the above said mount which influences and restrains free expansion.

Mounting designs for use in getter assemblies are known: see for example detail No. 26 in FIG. 2A, 2B and 2C of U.S. Pat. No. 4,323,818. Unfortunately, as it is shown in the above figures, the antenna mount is in contact with the lower wall of the getter material holder and is welded to it at points relatively close to the outside walls.

This fact leads to at least two disadvantages:

(1) The support acts as a thermal sponge and leads to unequal heating of the getter material during evaporation and therefore to an uneven expansion and to a consequent breakage with the release of loose particles;

(2) The getter material container undergoes distortions in consequence of its unequal expansion with respect to that of the support.

An attempt to overcome these difficulties has been made by fixing the support to a central position on the container but, when the diameter of the internal sidewall is decreased its becomes mechanically difficult to perform the welding and to also locate the support element which holds the getter material container from the wall of the cathode ray tube.

OBJECTS OF THE INVENTION

It is therefore an object of the present invention to overcome one or more of the above disadvantages of traditional getter assemblies.

It is another object of the present invention to overcome one or more of the above disadvantages of traditional getter assemblies.

Figure 1:
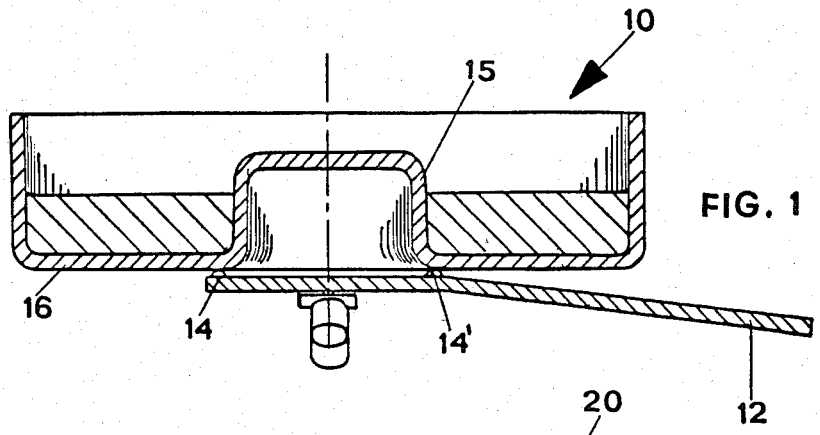
Figure 2:
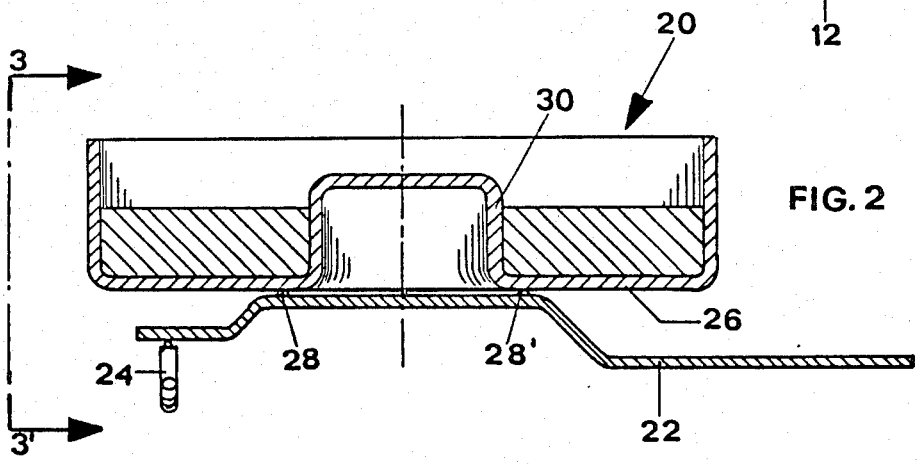
Figure 3:
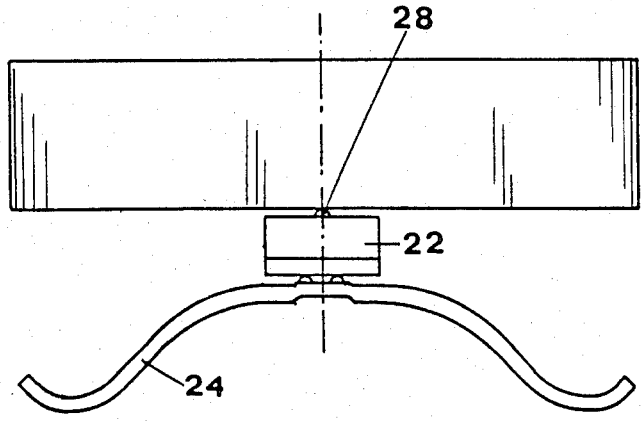

FIG. 1 shows a cross-section of a getter assembly according to the present invention, FIG. 2 shows a cross-section of a second preferred embodiment according to the present invention, and FIGS. 3 shows a view along line 3—3' of FIG. 2.

DESCRIPTION OF THE INVENTION

The present invention therefore provides a getter assembly for a cathode ray tube comprising a getter material container having an external sidewall, and an internal sidewall and a bottom wall which connects said external sidewall to said internal sidewall, thus defining a circular channel containing powdered getter material, the upper edge of said internal sidewall is powdered formed around a substantially disc-shaped element so as to constitute an upper raised bottom portion, there is also present an antenna mount in the form of a small rectangular cross-section bar coincident with the diameter of said container and carrying a support means lying in a plane perpendicular to said antenna mount characterized by the fact that the antenna mount touches said bottom wall and is welded thereto only in zones very close to said internal sidewall.

It is understood that the expression "getter material", as used in the present specification and in the relative claims, includes the material both prior to and after getter metal vapour release. This term embraces both the material in the form sold with the getter device and in the form in which it is found in an operating tube wherein the bulk of the getter metal has been evaporated from the material and is in the form of a film on the inside surface of the tube.

Referring now to FIG. 1, there is shown a getter assembly 10 having an antenna mount 12 welded in points 14, 14' very close to internal sidewall 15. As can be seen antenna mount 12 is distanced from lower wall 16 of getter container in all positions except from points 14, 14'.

Getter assembly 20 as shown in FIGS. 2 and 3 comprises a modified getter mount 22, such as to allow different positioning of support element 24. Also in this case antenna mount 22 is welded to lower wall 26 at points 28, 28' near to internal side wall 30.

It is preferable that the welding of the antenna mount to the bottom wall of the container, for getter assemblies of conventional size, takes place at a radial distance not greater than 2 mm from the circle which defines the intersection between the internal sidewall and the bottom wall. The getter assembly preferably has a ratio between the width and height of the annular channel greater than 3:1. The diameter of the upraised bottom portion defined by the internal sidewall can be less than about 3 mm.

Allthough the present invention has been described in detail with reference to certain preferred embodiments and uses, it is clear that variations and/or modifications can be made without departing from the spirit and scope of the invention.

I claim:

1. A getter assembly for a cathode ray tube comprising a getter material container having an external sidewall, an internal sidewall and a bottom wall connecting said external sidewall to said internal sidewall, so as to define an annular channel containing powdered getter material, the upper edge of said internal sidewall being integrally formed round a substantially disc-shaped element so as to define an upraised bottom portion as well as an antenna mount in the form of a small bar coincident with a diameter of said container and having a support means lying in a plane perpendicular to said antenna mount, the antenna mount touching said bottom wall and welded thereto only in zones very close to said internal sidewall.

2. A getter assembly according to claim 1 in which the welding of the antenna mount to the bottom wall is at a radial distance not greater than 2 mm with respect to the internal sidewall.

3. A getter assembly according to claim 1 in which the ratio between the width and the height of the channel is greater than 3:1.

4. A getter assembly according to claim 1 in which the diameter of the internal sidewall is less than about 3 mm.

5. A getter assembly for a cathode ray tube comprising a getter material container having an external sidewall, an internal sidewall and a bottom wall connecting said external sidewall to said internal sidewall, so as to define a channel containing powdered getter material, the upper edge of said internal sidewall being integrally formed round an upraised bottom portion and an antenna mount in the form of a small rectangular cross-section bar coincident with a diameter of said container and a support means lying in a plane perpendicular to said antenna mount, said antenna mount touching said bottom wall and being welded thereto at a radial distance not greater than 2 mm with respect to the internal sidewall, the diameter of the internal sidewall being less than 3 mm.

* * * * *